United States Patent [19]

Lin

[11] Patent Number: 4,735,593

[45] Date of Patent: Apr. 5, 1988

[54] PROGRAMMABLE TOY WITH WHEELS

[76] Inventor: Goang-wen Lin, P.O. Box 10780, Taipei, Taiwan

[21] Appl. No.: 923,812

[22] Filed: Oct. 27, 1986

[51] Int. Cl.[4] ..... A63H 17/395

[52] U.S. Cl. ..... 446/436; 446/460

[58] Field of Search ..... 446/436, 437, 460, 468, 446/449, 462; 180/79

[56] References Cited

U.S. PATENT DOCUMENTS

| | | | |
|---|---|---|---|
| 2,146,708 | 2/1939 | Barrett | 446/436 |
| 2,421,041 | 5/1947 | Swenson | 446/436 |
| 3,780,470 | 12/1973 | Roberts et al. | 446/436 |

*Primary Examiner*—Mickey Yu

[57] ABSTRACT

A programmable wheeled toy having a pair of steerable wheels and a pair of motor driven wheels. The steerable wheels are controlled by a programmable mechanism. The mechanism includes two parallel belts mounted to be driven by the motor. A plurality of shaft members mounted to the belts and each having thereon a slidable roller member manually positionable along the length of the shaft. A lever operatively connected to the steering wheels at one end and having the other end positioned to be contacted by the roller members to cause the lever to pivot and steer the steering wheels, and in turn cause the toy to move in a predetermined pattern.

4 Claims, 2 Drawing Sheets

PROGRAMMABLE TOY WITH WHEELS

BACKGROUND OF THE INVENTION

Conventionally, a wheeled toy was designed to move forward in fixed directions mechanically, such as moving straightaway only, or turning instantly after bumping into a obstacle because of an additional colliding device, then still moving straightaway as usual. The moving was quite monotonous and without much interest.

Later on, there came toys such as remote-control model cars, but their consumption of power and cost for production were both too high to make them as popular products.

Another type of prior art device is disclosed in U.S. Pat. No. 2,146,708 issued on Feb. 14, 1939 to W. E. Barrett as: A toy having a spring for straightening the steering means to cause the toy normally to travel in straight line, and several push rods mounting in corresponding apertures around the periphery of a disk and that of a gear. When said push rods normally centrally located, they won't strike the bell cranks, therefore, the toy will move straightaway. When any said push rods is adujsted out of its normal central position, it will strike said bell crank during rotation of said disk and said gear to cause a tie rod to operate the steering element to make the toy turn right or left. The said push rods may be selectively pushed by an operating elements to help the player determine the course of the toy.

While another type of prior device is disclosed in U.S. Pat. No. 2,421,041 issued on May 27, 1947 to A. W. Swensow as: A toy having a plurality of sets (by pair) of cams mounted on a cam shaft and said cam pairs are selected by a shifter member; each cam pair include one cam to control the shifting of clutch and the other cam to control the steering mechanism by operating through the reciprocation of a follower bar.

Still another type of prior art device is disclosed in U.S. Pat. No. 2,146,708 dated on Dec. 25, 1973 to Robert E. Roberts as:

A toy vehicle having a flexible member, such as a cord or cable, which is wound on a program drum with a multiplicity of projecting pegs arranged equispaced laterally in parallel circumferential rows, said cord being led from a storage spool around the program drum and between the pegs by an eye on a lever connecter to operate the steering mechanism of the toy vehicle.

In comparison with above prior art devices, this invention is featured of much simpler construction and easier operation with only several position-adjustable protruding devices mounting on shafts carried by two parallel tracks to push a lever to operate the steering mechanism, then to determine the course for the toy vehicle without complicated members either for drive or for steering mechanism.

OBJECTS OF THE INVENTION

The main object of this invention is to provide a wheeled toy that may turn around at player's will, therefore, to improve toy monotony of conventional wheeled toy.

Another object is to offer a programmable wheeled toy for which children may set the course. While a further object is to provide a wheeled toy of simple construction and low production cost.

BRIEF SUMMARY OF THE INVENTION

In order to achieve above objects, frame of the toy under this invention comprises steering wheels and driving wheels, and also two power-driven tracks to carry several shafts with several position-adjustable protruding devices disposed. When the tracks get rotating, those devices will push a lever one after another, then the lever will swing and change the direction of steering wheels through a pull rod. Thus the player may determine the moving course for his toy in advance.

BRIEF DESCRIPTION OF THE DRAWING

Accompanying drawings will further illustrate features and functions of this invention.

DETAILED DESCRIPTION OF THE INVENTION

Figure 6:
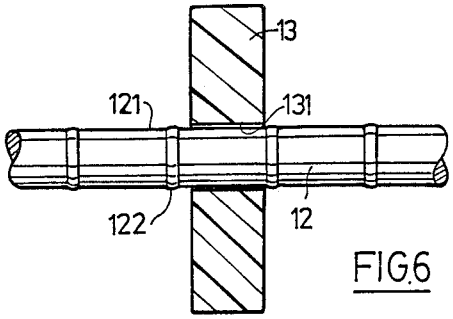
FIG. 6 is an enlarged top view of the roller and axle of FIG. 2 with the roller shown in cross section.

This invention covers two rotatable tracks which can carry several shafts with several position-adjustable protruding devices which in turn will push the steering lever for steering wheels. This will enable the toy to move forward or turn around according to predetermined course. Following description and above mentioned drawings may explain this invention in details as:

Two tracks 10 made of flexible material are mounted separately on the said belt wheels 11, and along internal side of each track, there are several corresponding shaft holes 101 to secure ends of shafts 12. Each shaft 12 holds a protruding device, such as a freely revolving roller 13. FIG. 6 is to show said shaft with several necks 121 slightly wider than roller 13, and connecting shaft knots 122 whose outer diameter is slightly larger than the inner diameter of hole 131 of roller 13, so that inner hole 131 of suitable flexibility may make roller 13 stay in any neck 131 when roller 13 is adjusted by axial forces along the axis line, but when roller 13 is revolving from friction, shaft knot 122 will block the said roller from sliding during axial revolving.

As to belt wheels 11 of track 10, the rear ones are secured on driving axle 14 connected to a decelerating gear set 15 transmitting power from motor 16. While another gear set 17 fixed on the other end of shaft 161 of motor 16 functions to drive axle 18 to rotate driving wheels 19. When motor 16 starts to work,the toy will move forward. Motor 16 is powered by dry cells 20 built in frame 30 which is apparently designed to bear all mechanisms.

Figure 1:
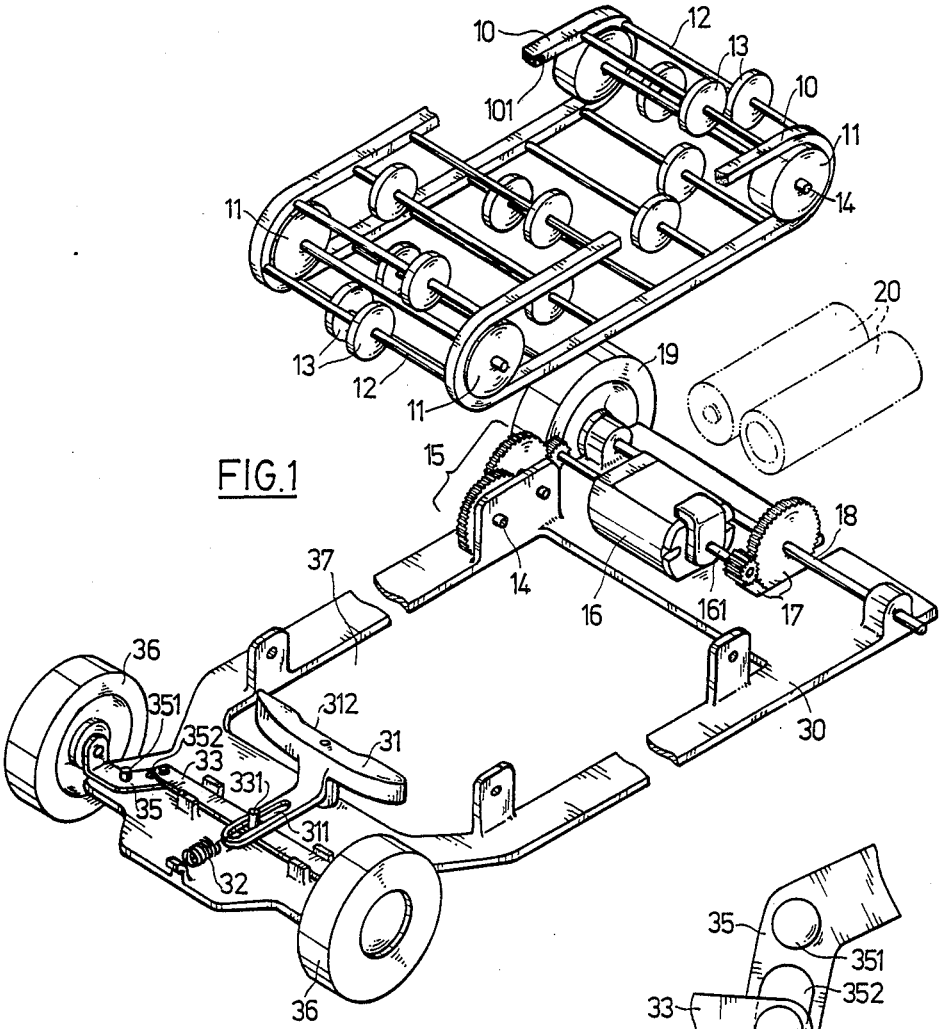
FIG. 1 is an exploded perspective view of the invention.
Figure 3:
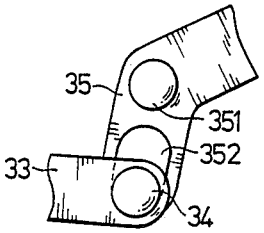
FIG. 3 is an enlarged top view showing the arrangement of the pull rod and swinging rod of FIG. 2.
Figure 2:
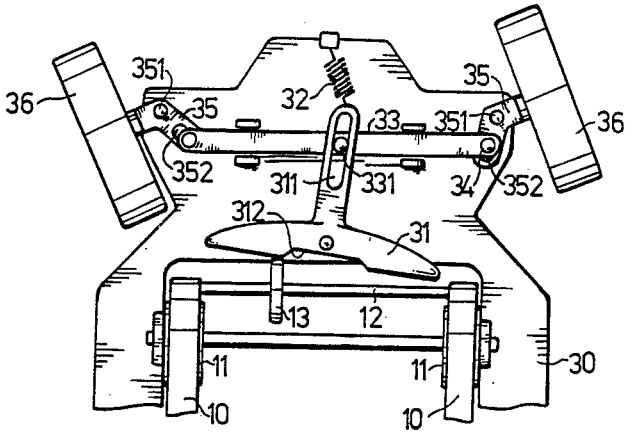
FIG. 2 is a top plan view of the embodiment as shown in FIG. 1 with parts removed.

In front of tracks 10, closely pivoted on frame 30 is lever 31 with tail-shaped rear end which roller 13 may push to swing lever 31, while slot 311 is one the front end and because of tention from spring 32 with one end secured to lever 31 and the other end to frame 30, lever 31 may always be kept in normal position. In the middle of rod 33, vertical shaft 331 is put in slot 311 of lever 31, and both ends of rod 33 are separately pivoted by pin 34 to swing rods 35 whose outer end is tightly secured with steering wheels 36. Swing rods 35 are centrally fixed on frame 30 by shaft 351, and comprises slot 352 pivotally holding pins 34 of rod 33. As shown in FIG. 2, when the left side of tail rear end for lever 31 is pushed by roller 13 from rotating movement of tracks 10, the said lever 21 will swing to the right hand side, and bring rod 33 to move to the right, therefore, to make both swing rods 35 steer wheels 36 to turn left; then the toy may turn left as well. But there will be some difference of turning angles between the left wheel and the right one. As shown in FIG. 3, slot 352 of swing rod 35 will absorb the mentioned difference, so as to prevent the toy from jolting during turning in forward movement.

Figure 4:
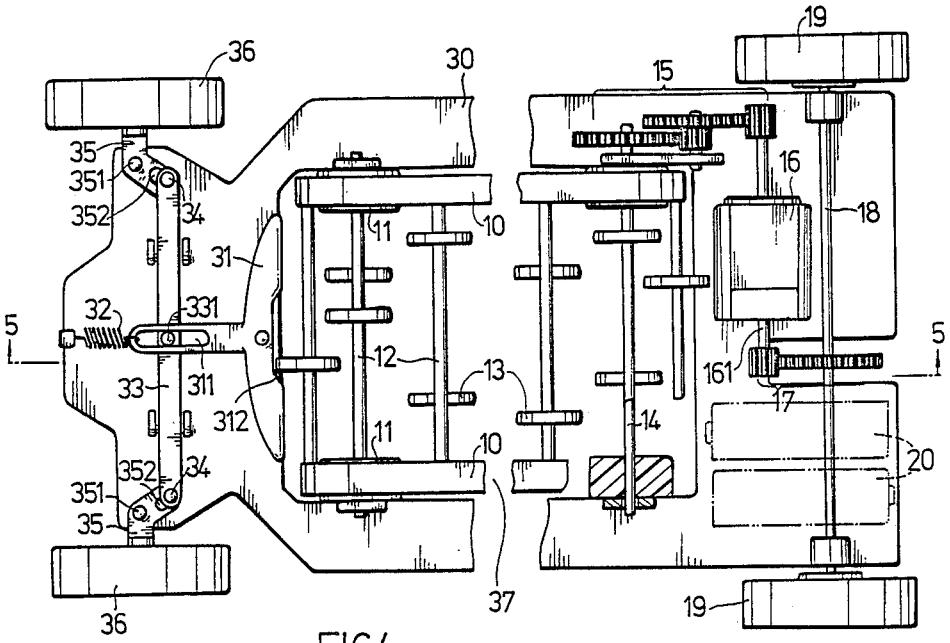
FIG. 4 is a top plan view of the invention.
Figure 5:
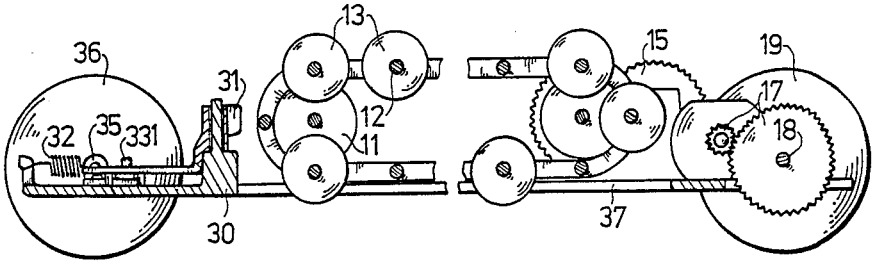
FIG. 5 is a cross-sectional view of FIG. 4 taken in the direction of arrows 5—5.

A space 37 corresponding to that under the tracks 10 is specially reserved in frame 30, so the children may use their fingers to adjust rollers 13 to any positions on shaft 12. FIGS. 2 and 4 illustrate when roller 13 is positioned close to the pivotal point of lever 13 in advance, lever 31 will be pushed and incline with a larger angle, then inevitably, the toy will turn accordingly. When roller 13 is positioned far away from center of the toy, lever 31 will incline with a smaller angle. As FIG. 4 shown, when roller 13 is positioned in the center of the toy, i.e. into the concave arc 312 of lever 31, the said roller can't push lever 31, then as lever 31 is strained by spring 32 in normal position, steering wheels 36 will move straightaway.

I claim:

1. A programmable wheeled toy comprising:

a frame;

a drive mechanism including a motor mounted on said frame;

a pair of flexible tracks rotatably mounted on said frame and are operatively driven by said motor, said pair of tracks further having a plurality of parallely spaced shafts mounted between said tracks, each one of said shafts supporting thereon a protruding device capable of being manually and repeatedly repositioned alone an axial length of a respective shaft;

a lever pivotably mounted on said frame, said lever comprising two rear end portions positioned to be contacted by said protruding devices to pivot said lever to the right or the left with respect to said frame;

a rod movably mounted on said frame and is engaged by a forward end of said lever for movement by said lever, said rod further operatively engaging a pair of wheels for steering said wheels, whereby each time a protruding device engages a rear end portion of said lever, said lever will pivot and cause said rod to steer said pair of wheels for controlling the direction of travel of said toy.

2. A programmable wheeled toy of claim 1 wherein said protruding devices are each formed as a roller.

3. A programmable wheeled toy of claim 2 wherein said shafts each having a plurality of knots to allow said rollers to be manually adjusted to various positions on said shafts and to prevent said rollers from moving away from their adjusted positions.

4. A programmable wheeled toy of claim 1 wherein said lever has a concave arc formed between said two rear end portions so that said protruding devices may pass through said concave arc without contacting said lever.

* * * * *